United States Patent [19]

Angelini

[11] 4,054,534

[45] * Oct. 18, 1977

[54] VOLATILE CLEANING SOLUTION FOR MIRRORS AND LENSES

[75] Inventor: Dominic J. Angelini, Webster, N.Y.

[73] Assignee: Xerox Corporation, Stamford, Conn.

[ * ] Notice: The portion of the term of this patent subsequent to Sept. 7, 1993, has been disclaimed.

[21] Appl. No.: 691,056

[22] Filed: May 28, 1976

[51] Int. Cl.[2] ..... C11D 7/06

[52] U.S. Cl. ..... 252/158; 252/156; 252/162; 252/170; 252/172; 252/DIG. 10; 134/38; 355/15

[58] Field of Search ..... 252/156, 158, 162, 170, 252/172, DIG. 10; 134/4, 6, 38; 355/15; 15/100

[56] References Cited

U.S. PATENT DOCUMENTS

| | | | |
|---|---|---|---|
| 3,463,735 | 8/1969 | Stonebraker et al. | 252/DIG. 10 |
| 3,728,269 | 4/1973 | Stephenson et al. | 252/171 |
| 3,814,693 | 6/1976 | Kudler | 252/DIG. 10 |
| 3,819,522 | 6/1974 | Zmoda et al. | 252/DIG. 10 |
| 3,979,317 | 9/1976 | Angelini | 252/170 |

*Primary Examiner*—Mayer Weinblatt

*Attorney, Agent, or Firm*—James J. Ralabate; Donald C. Kolasch; Paul A. Leipold

[57] ABSTRACT

A cleaning composition is provided which includes a lower alcohol, ultrapure water, a surfactant, 3,5-dimethyl-1-hexyn-3-ol and ammonia solution. This cleaning solution is 100 percent volatile, water-clear, and contains no solids or colloidal matter, in addition to being contaminant- and particulate-free, it is found to leave no detectable residue even if not fully wiped off in a cleaning operation.

13 Claims, No Drawings

VOLATILE CLEANING SOLUTION FOR MIRRORS AND LENSES

BACKGROUND OF THE INVENTION

This invention relates to cleaning compositions and more particularly to the cleaning of lens and mirror surfaces. More specifically, this invention relates to the cleaning of lenses and mirrors employed in imaging for electrophotograhic imaging processes.

In an electrophotographic imaging process, for example, more specifically disclosed in Carlson U.S. Pat. No. 2,297,691, an electrophotographic plate comprising a photoconductive insulating material on a conductive backing is uniformly charged over its surface and then exposed selectively to produce a latent electrostatic image. Thereafter a latent electrostatic image is developed employing an electroscopic marking powder known in the art as toner normally employed in connection with a carrier to form a visible reproduction of the original employed. This development of the latent electrostatic image generally employs an electrostatically attractable material which is normally a thermoplastic resin in the form of finely-divided particles usually in the range of from 3 to 20 microns. The toner is applied by bringing the photoconductive surface bearing the latent electrostatic image into contact with the powder, the charged areas normally retaining the toner particles. The developed image may then be transferred to a suitable support material such as paper and then fixed if desired by heating and/or application of a solvent or the like. In the transfer step substantially all of the resin material or toner adheres to support material to form the image thereon, but usually a very small percentage of the resin material or toner remains on the electrophotographic surface.

These trace amounts of resin material or toner remaining on the electrophotographic surface are found to affect future operating steps of the process, and if left to remain thereon, will provide an undesirable cumulative effect. Additional residue toner particles adhere more readily to the surface in both image and non-image areas and consequently image deterioration results. In automatic imaging machines employing rotary drums, continuous cleaning of such residual toner particles is effected with a rotating brush in peripheral contact with the surface of the electrophotographic surface which removes any residual resin material or toner adhering thereon. This brush in turn is cleaned by the use of a flicking bar in combination with a vacuum system whereby residual resin material or toner removed from the brush by the flicking bar is entrained in air and then subsequently separated from the air by a suitable filter.

The imaging, developing, fusing and cleaning steps are carried out numerous times in a commercial xerographic reproduction machine in the ordinary course of its use. As these processes are repeated, small amounts of oil, toner, dust, silicone fuser oil and paper particles are released inside the machine. Some of the material released settles on and contaminates the mirrors and lens employed in the copier. A build-up of these contaminants interferes with transmission of a clear, sharp image of the article to be copied to the photoreceptor. It has been difficult to clean lenses and mirrors of contaminants without leaving residue from the cleaning operation.

Washing techniques have been employed to remove loosely held toner residue employing non-solvent liquids such as water, alcohols and mixtures thereof. However, residue toner which is firmly held by any means, e.g. chemical or non-chemical, is not effectively removed with these wash techniques. In addition, these wash substances contain alcohols in concentrations which are flammable. Liquids which are considered non-flammable are those which exhibit flash point at or about 140° F as described in *Fundamentals of Industrial Hygiene* published by the National Safety Council, 1971. Solutions containing water, alcohol, surfactants, hydrocarbon solvents, emulsifiers, such as ammonia, lubricants, such as silicones, and polishing agents have also been proposed for lens and mirror cleaning solutions. However, these are not totally satisfactory as the lubricants and polishing agents leave residue on the lenses and mirrors thereby changing the optical properties. Further, the polishing agents such as $TiO_2$, $ZrO_2$ and $NbO_2$ mar the finish of the lenses and mirrors by their abrasive action. The alcohol cleaners of isopropanol are not of high purity and contain impurities. Further, the alcohol cleaners do not effectively remove silicone oils and toner.

In U.S. Pat. No. 3,702,303 a composition for cleaning photoconductive insulating surfaces comprising an aqueous-organic liquid emulsion in a surfactant is disclosed. The composition recited may include an abrasive and a suspending agent and preferably includes a non-flammable organic liquid such as, for example, tetrachloroethylene which is emulsified in the water in an amount to control the volatility thereof and thereby provide a composition which evaporates from the surface to be cleaned at a rate that permits effective cleaning without producing solvent films or stains. However, the emulsifiers and possible abrasives employed leave residues which are not desirable in some applications and must be dry-wiped.

There is, therefore, a demonstrated need to provide improved cleaning compositions for lens and mirror surfaces.

It is, therefore, an object of this invention to provide a cleaning composition for lens and mirror surfaces devoid of the above noted deficiencies.

A further object of this invention is to provide a cleaning composition for cleaning that leaves no residue on a lens or mirror.

Another object of this invention is to provide a non-abrasive cleaning composition suitable for cleaning lens and mirror surfaces in automatic electrophotographic imaging machines.

Yet another object of this invention is to provide cleaning compositions which do not leave residue if spilled in an imaging machine.

A further object of this invention is to provide a cleaning solution of 100 percent volatility.

An additional object of this invention is to form a cleaning solution for removal of toner and silicone oil.

Yet again another object of this invention is to provide a novel cleaning composition which will not alter or affect the light transmission properties of conventionally employed lenses and mirrors.

These and other objects of the instant invention are accomplished generally speaking by providing a cleaning composition comprising a lower alcohol, for example ethyl and methyl alcohol, water, ammonia solution, and a non-ionic surfactant, 3,5-dimethyl-1-hexyn-3-ol, sold under the Tradename of Surfynol 61® by Air Products and Chemicals, Inc.

This cleaning solution is 100 percent volatile, water-clear and is found to contain no solids or colloidal matter, in addition to being contaminant- and particulate-free when properly filtered through less than 0.1 micron absolute membrane filters and thus, is found to leave no detectable residue even if not fully wiped off in a cleaning operation or spilled into areas that can not be reached. It is found to have a sufficiently low surface tension, lubricity, and other cleaning properties which may permit it to be used universally for cleaning all lenses, mirrors and glass surfaces and is effective for all contaminants produced in these xerographic devices such as loose non-compacted toners, toner fines, paper tars and silicone oil condensate among others.

Preferably, the components of the instant cleaning solution are provided in near absolute purity and freedom from particulates insofar as economically practicable; for example, the alcohol is S.D.A. 3A 200 proof grade and the water is greater than 10 megohm-cm, less than 0.1 micron absolute quality ultrafiltered.

However, the most significant property of this cleaning composition as above alluded to, is its ability, due to the presence of the ammonia solution and Surfynol 61® surfactant, to actually be 100 percent volatile after the cleaning operation. As the solution is completely volatilized, it leaves no residue to effect light transmission and reflectance. Prior totally volatile solutions were not effective in removal of oils and toner.

In use, the solution is primarily applied to the lenses and mirrors during cleaning of the copier. The solution is normally provided to be used with a rayon cleaning batting which is provided to be non-residue forming and non-abrasive. However, it may also be employed as a solution in a pre-impregnated pad or applied to pads at the point of use. While the cleaning ingredients are completely volatile and relatively pure as well as the cleaning pad or batting, and therefore, do not leave residues, spots or streaks in themselves, the lenses and mirrors being cleaned contain contaminants which will spot after being dislodged by the solution and batting and, therefore, must be removed before the solution is allowed to fully dry. The cleaning composition of the instant invention is found to have the necessary lubricating qualitites required to accomplish this if the wiping pad or batting process is employed.

Any suitable lower alcohol may be employed in the process of the instant invention. Typical lower alcohols include methanol, ethanol, isopropyl or n-propyl alcohol and mixtures of these and others. The lower alcohol employed may be present in any suitable ratio. However, generally the range of 30–95 parts per volume of alcohol per 70–5 parts per volume of water is employed and preferably about 70–95 parts per volume of lower alcohol to about 30–5 parts per volume of water and optimally about 90 parts per volume of alcohol to about 10 parts per volume of water, which gives good cleaning while retaining high volatility for rapid service and cleaning.

Although the water employed has been described as deionized, 18 megohm-cm quality, and ultrafiltered, any other suitable quality of water may be employed including distilled water of similar resistivity.

Any suitable ratio of surfactant may be employed in the composition of the instant invention, generally about 0.01–10 parts of surfactant by volume per 100 parts by volume of alcohol/water solution are employed while about 0.01–1 parts per volume of surfactant per 100 parts of alcohol/water solution are preferred, and about 0.05 part surfactant per approximately 100 parts solution is optimal. The surfactant as described above is referred to as Surfynol 61® (3,5-dimethyl-1-hexyn-3-ol).

Any suitable amount of ammonia solution may be employed in the composition of the invention. Typical of amounts of ammonia solution are about 0.1–5 parts by volume per 100 parts of alcohol/water solution. Suitable results are obtained using between about 0.1 and about 3 parts by volume per 100 parts by volume of alcohol/water solution. A preferred ratio is about 0.3 parts per volume ammonia solution per 100 parts of water/alcohol solution to give good cleaning without objectionable odor. Ammonia solution is a saturated solution obtained by bubbling ammonia gas through ultrapure water. It is also referred to as ammonia hydroxide and aqua ammonia.

The cleaning solution thus provided is found to have a very low surface tension, for example, about 25 dynes/cm compared with 72.9 dynes/cm for deionized water alone, when ethyl alcohol is the lower alcohol employed, enabling it to spread most surfaces and wet most contaminants encountered. The combination of ethyl alcohol, water, ammonia solution and surfactant, is found to provide a much wider range of contaminant removal than commercially employed isopropanol cleaning solutions, in particular, with regard to removal of silicone oil condensates and silicone oil resulting from the use of this substance commonly as a fuser paper release agent. Slightly slower evaporation characteristics provided by this solution allow more open working time for the removal of contaminants when a wiping process is employed. An advantage over previous commercially used film removers is the 100 percent essential volatility due to higher purity and control over the chemical components and packaging employed.

As before stated, if a low residue wiping material such as rayon batting is employed, maximum efficiency of the solution is realized, since only enough solution is used at the point of contamination where it is needed. Virtually no possible spillage of the solution droplets can occur in tight quarter critical areas, such as toner areas if a pre-impregnated pad is used. Problems encountered in spilling of the solution in tight quarters is minimized as the 100 percent volatility normally allows it evaporation without creating problems. In addition, higher efficiency is realized towards cleaning silicone oil/toner condensate, a relatively difficult to remove contaminant film commonly encountered and one which cannot be removed by prior proprietary cleaning solutions. It is also found when employing the cleaning solution of the instant invention, that since greater cleanability is provided its usage in borderline contamination causes may eliminate the need for cleaning with products which incorporate mild inert abrasives which may in some cases be undesirable. The cleaning solution also is found to possess very low toxicity from vapor inhalation and minimal skin contact effect due to the absence of grease solvent.

To further define the specifics of the present invention, the following examples are intended to illustrate and not limit the particulars of the present system. Parts and percentages are by volume unless otherwise indicated.

EXAMPLE I

The cleaning solution of ethyl alcohol, 90 parts, water greater than 10 megohm-cm purity, 10 parts, Surfynol 61 ®, 0.05 part and 0.3 part ammonia solution is mixed, filtered and applied employing rayon batting to a Xerox 3600's contaminated lens and mirror. The lens and mirror is found to be effectively and efficiently cleaned with no residue remaining. The lens and mirror are contaminated with toner, silicone oil condensate and other materials from the operation of a 3600 copier.

EXAMPLE II

The process as defined in Example I is again performed with the exception that the following cleaning solution is employed: ethyl alcohol, USP grade (obtained from U.S.I. Industrial Chemical Co.), 80 parts, deionized water, greater than 10 megohm-cm purity, 20 parts, and Surfynol 61 ®, 1 part and 1 part ammonia solution. The lens and mirror are found to be clean with no residue detectable.

EXAMPLE III

The process as defined in Example I is again performed with the exception that the following cleaning solution is employed: denatured alcohol, 100 parts ethanol and 5 parts methanol, S.D.A. 3A, 200 proof (obtained from U.S.I. Industrial Chemical Co.), 90 parts, deionized water, greater than 10 megohm-cm purity, 10 parts, and Surfynol 61 ®, .05 part, and 0.3 part ammonia solution. The lens and mirror are rapidly cleaned and quickly dry with no residue detectable.

EXAMPLE IV

The process as defined in Example I is again performed with the exception that the following cleaning solution is employed: denatured alcohol, S.D.A. 30, (100 parts ethanol and 10 parts methanol) 200 proof (obtained from U.S.I. Industrial Chemical Co.), 70 parts, deionized water, greater than 10 megohm-cm purity, 30 parts, Surfynol 61 ®, 1 part and 3 parts ammonia solution. The lens is cleaned without leaving residue.

EXAMPLE V

The process as defined in Example I is again performed with the exception that the following cleaning solution is employed: denatured alcohol, of 5 parts isopropyl and 95 parts of a 95/5 solution of ethanol and methanol, anhydrous, reagent (J.T. Baker Chemical Co., denaturants being methyl alcohol, isopropanol), 95 parts, deionized water, greater than 10 megohm-cm purity, 5 parts Surfynol 61 ®, 0.02 part and ammonia solution 0.2 part. The lens and mirror are cleaned easily and are residue-free.

EXAMPLE VI

The process as defined in Example I is again performed with the exception that the following cleaning solution is employed: 2-propanol, spectrophotometric grade, analyzed reagent (J.T. Baker Chemical Co.), 80 parts, deionized water, greater than 10 megohm-cm purity, 20 parts, Surfynol 61 ®, 3 parts and ammonia solution 0.6 part. The lens and mirror are clean and residue-free.

Although the present examples were specific in terms of conditions and materials used, any of the above listed typical materials may be substituted when suitable in the above examples with similar results. In addition to the steps and materials used to carry out the process of the present invention, other steps or modifications may be used if desirable. In addition, other materials may be incorporated in the system of the present invention which will enhance, synergize, or otherwise desirably affect the properties of the systems for their present use. For instance, volatile perfuming agents may be added to the cleaning solution. The cleaning solution may also be used to clean other materials such as the glass platen and exposure lamps of a copier.

Anyone skilled in the art will have other modifications occur to him based on the teachings of the present invention. These modifications are intended to be encompassed within the scope of this invention.

What is claimed is:

1. A method of cleaning lenses and mirrors of electrophotographic copiers comprising providing a filmed lens or mirror surface, applying a cleaning solution which consists essentially of lower alcohol, ultrapure water, ammonia solution and 3,5-dimethyl-1-hexyn-3-ol surfactant.

2. The method as defined in claim 1 wherein said lower alcohol is a mixture of 100 parts by volume ethanol and 5 parts methanol.

3. The method as defined in claim 1 wherein said water has the quality of greater than 10 megohm-cm resistivity and is ultrafiltered.

4. The method as defined in claim 1 wherein said alcohol is selected from the group consisting of ethanol, methanol, propyl and mixtures thereof.

5. The method as defined in claim 1 wherein said alcohol is present in 70–95 parts for 100 parts of total solution.

6. The method as defined in claim 1 wherein said surfactant is present in a range of from 0.01 parts of surfactant by volume to 100 parts of solution to 1 part of surfactant to 100 parts of alcohol/water solution.

7. The method as defined in claim 1 wherein said filmed surface is filmed with material selected from the group consisting of silicone oil, silicone oil condensates, toner polymer residue, paper lint and mixtures thereof.

8. The method as defined in claim 1 wherein said ammonia solution is present in an amount between about 0.1 and 3 parts per 100 parts of alcohol/water solution.

9. The method of claim 1 wherein said ratio of alcohol to water is about 30–5 parts by volume of said water per about 70–95 parts of said alcohol and said surfactant consists of about 0.01–1 parts of surfactant per 100 parts of alcohol/water solution.

10. The method of claim 1 wherein said lower alcohol is selected from the group consisting of ethanol, methanol and mixtures thereof.

11. A method of cleaning surfaces of lenses and mirrors of electrophotographic copiers comprising providing a surface filmed with material selected from the group consisting of toner polymer residue, silicone oil, silicone oil condensates, and mixtures thereof, applying a cleaning solution consisting essentially of lower alcohol, ultrapure water, ammonia solution and 3,5-dimethyl-1-hexyn-3-ol surfactant to said surface, with the proviso that the ratio of said alcohol to said water is about 30–95 parts of said alcohol per about 70–5 parts water, said ammonia solution is present in an amount between about 0.1 and 3 parts per 100 parts alcohol/water solution and that said surfactant consists of about 0.01–5 parts per 100 parts of said alcohol/water solution.

12. The method of claim 11 wherein said lower alcohol is selected from the group consisting of isopropyl, n-propyl, methanol, ethanol and mixtures thereof.

13. The method of claim 11 wherein said surfactant is present in an amount between about 0.1 and 3 parts per 100 parts of alcohol/water solution.

* * * * *